United States Patent [19]

Leupold et al.

[11] Patent Number: 4,692,732

[45] Date of Patent: Sep. 8, 1987

[54] REMANENCE VARYING IN A LEAKAGE FREE PERMANENT MAGNET FIELD SOURCE

[75] Inventors: Herbert A. Leupold, Eatontown; Ernest Potenziani, II, Ocean; John Clarke, Cranford, all of N.J.

[73] Assignee: The United States of America as represented by the Secretary of the Army, Washington, D.C.

[21] Appl. No.: 868,862

[22] Filed: May 30, 1986

[51] Int. Cl.[4] ..... H01F 7/02

[52] U.S. Cl. ..... 335/302; 335/301; 335/304

[58] Field of Search ..... 335/210, 211, 214, 301, 335/302, 304, 306; 315/3.5, 5.35

[56] References Cited

U.S. PATENT DOCUMENTS 3,205,415 9/1965 Seki et al. ..... 335/301 X
3,428,867 2/1969 Becker ..... 335/284 X
3,609,611 9/1971 Parnell ..... 335/284
3,624,572 11/1971 Mallinson ..... 335/284 X

FOREIGN PATENT DOCUMENTS 152200 11/1979 Japan ..... 335/284
180486 6/1982 Japan ..... 335/284

*Primary Examiner*—George Harris
*Attorney, Agent, or Firm*—Sheldon Kanars; Jeremiah G. Murray; John K. Mullarney

[57] ABSTRACT

A magnetic circuit with a remanence varying cylindrical magnet having a bore and a remanence varying cladding magnet circumscribing the cylindrical magnet creating a longitudinally increasing axial magnetic field within the bore. The cladding magnet has a radial magnetization transverse to the axial magnetization of the cylindrical magnet resulting in a constant magnetic potential along the outer exterior surface of the magnetic circuit.

14 Claims, 3 Drawing Figures

FIG. 1
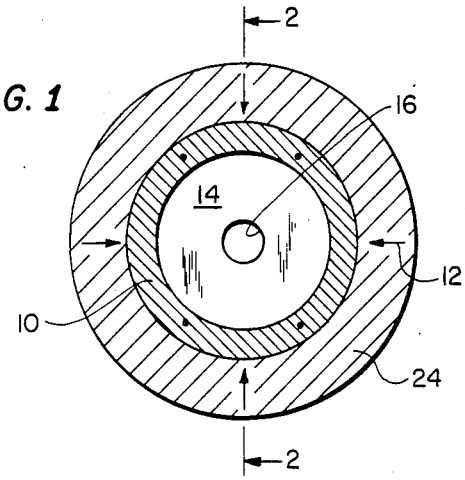
FIG. 2
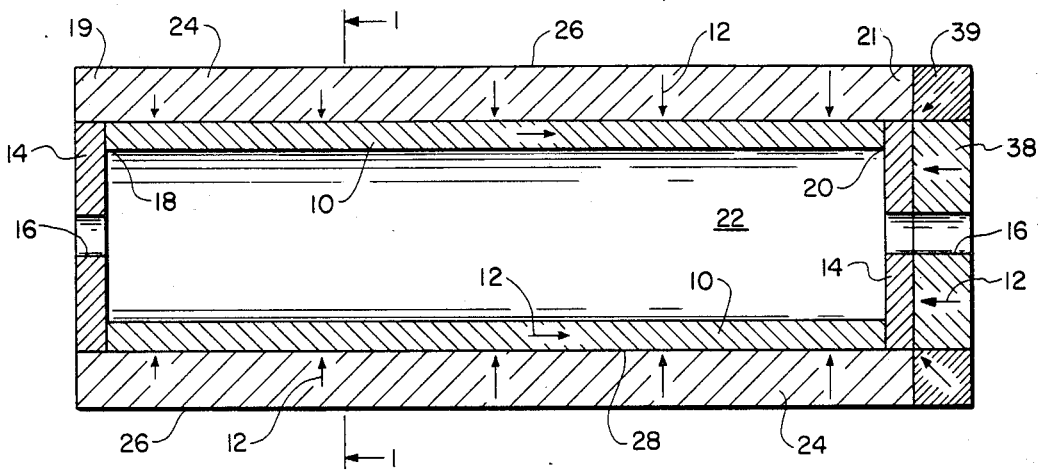
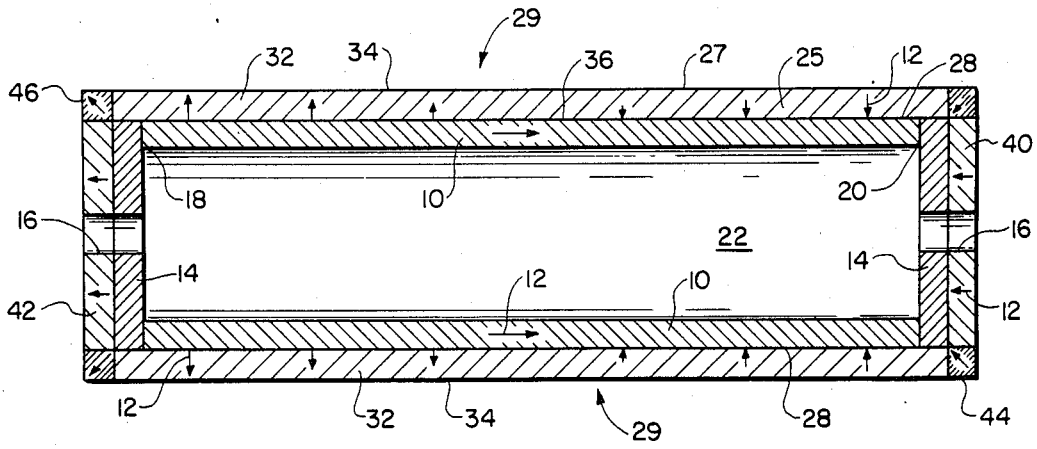
FIG. 3

REMANENCE VARYING IN A LEAKAGE FREE PERMANENT MAGNET FIELD SOURCE

This invention may be manufactured and used by or for the Government for Governmental purposes without the payment of any royalties thereon or therefor.

CROSS REFERENCE TO RELATED APPLICATION

This application is related to the following copending application Ser. No. 868,863 filed on May 30, 1986, entitled "A Leakage Free Linearily Varying Axial Permanent Magnet Field Source", in which one of the present applicants is the inventor.

BACKGROUND OF THE INVENTION

1. Field of The Invention

This invention relates generally to the field of magnetically cladded magnetic circuits for eliminating undesirable exterior magnetic fields and intensifying desired magnetic fields, and more specifically to a magnetic circuit having an increasing axial magnetic field and cladding therefor of constant radial thickness.

2. Description of Prior Art

Various magnetic devices requiring a controlled magnetic field, such as klystrons, traveling waves tubes, microwave devices, and other magnetic circuits have employed magnetic cladding to help intensify the desired controlled magnetic field as well as to reduce the exterior effects of the magnetic circuit on the surrounding environment due to magnetic field leakage. All of these devices have included a uniform controlled magnetic field and varied geometric configurations.

Those concerned with the development of magnetic devices have long recognized the need for improving the magnetic intensity per unit weight of magnetic circuits, thereby improving the overall size and cost of such devices. The various prior art devices have used magnetic cladding to reduce the exterior flux leakage and increase the desired controlled magnetic field intensity without appreciably increasing the size or weight of the magnetic circuit. As a result, the prior art devices are configured so that most of the flux generated by a magnet creating the controlled magnetic field in directions skewed from the main axis of the controlled magnetic field is redirected to increase the magnetic intensity along the main axis. The prior art devices have relied on geometric configurations of the cladding magnets resulting in cumbersome shapes having large dimensions. Although prior art devices have served their purpose, they have not been applicable in all situations and have not gone far enough in maximizing size and weight reduction.

SUMMARY OF THE INVENTION

In general, the invention comprehends a magnetic structure which comprises, a constant radial thickness remanence varying axially magnetized cylindrical magnet having an axial bore therethough, and a constant radial thickness remanence varying radially magnetized cladding magnet coaxially circumscribing the cylindrical magnet.

In the present invention, the combination of the specific parametric configuration, the varying of the remanence, of the magnetic cladding structure and the specific orientations of the polarity of the cladding structure with respect to the magnetic circuit effect a considerable reduction in size, weight, and cost over that achievable with prior art structures. The magnetic cladding in the present invention is improved by taking advantage of the magnetic material's ability to be polarized in opposite directions, and by parametrically varying the remanence resulting in a constant magnetic potential on the exterior surface equal to the magnetic potential at a specific point on the magnetic circuit. The present invention also improves upon the ability of a magnetic circuit to create a longitudinally varying magnetic field while providing a device having a constant diameter.

It is therefore an object of this invention to provide an improved magnetic construction wherein a longitudinally varying magnetic field is created and wherein the leakage flux is minimized.

It is another object of the invention to provide a magnetic construction having an improved magnetic intensity per unit weight ratio.

It is a feature of this invention to have a hollow constant radial thickness magnet generate a longitudinally varying magnetic field cladded by a second magnet having a constant radial thickness with both magnets having longitudinally varying remanences which result in improved magnetic fields with reduced magnetic flux leakage.

It is an advantage of this invention that a longitudinally varying magnetic field can be generated with a substantial savings in size, weight, and cost.

The exact nature of this invention as well as other objects, features, and advantages thereof will be readily apparent from a consideration of the following specification.

BRIEF DESCRIPTION OF THE DRAWINGS

FIG. 1 is a cross section of the invention cut along the line 1—1 in FIG. 2 and looking in the direction of the arrows.

FIG. 2 is a longitudinal cross section of the invention cut along the line 2—2 in FIG. 1 and looking in the direction of the arrows.

FIG. 3 is a longitudinal cross section of another embodiment of the invention.

DETAILED DESCRIPTION OF THE DRAWINGS

FIG. 1 shows a cross section of the present invention. Magnet 10 is an axially magnetized cylindrical magnet having a bore therethrough. The dots on magnet 10 represent that the direction of magnetization is such that the north pole of magnet 10 is directed out of the drawing and toward the viewer. Magnet 10 also has a varying remanence along its longitudinal length. The varying remanence is created during magnetization of the magnet by controlling the magnetic field. At the magnetic material's saturation field the magnetic remanence of the material will be the greatest. By controlling the strength of the field to something below saturation a magnetic remanence can be created for any value up to the remanence value at saturation. Magnet 10 is coaxially circumscribed by remanence varying bucking cladding magnet 24. Magnet 24 is radially magnetized. Arrows 12 on magnet 24 represent the direction of magnetization. The heads of arrows 12 point in the direction of the north pole of magnet 24. Magnet 24 also has a varying remanence along its longitudinal length.

FIG. 2 shows a longitudinal cross section of the present invention. Cylindrical magnet 10 having a coaxial cylindrical bore 22 therethrough is magnetized in the axial direction as represented by arrows 12 thereon. The heads of arrows 12 point in the direction of the north pole of magnet 10. The varying remanence of magnet 10 varies from a low remanence at end 18 to a high remanence at end 20. Adjacent each end 18 and 20 an iris 14 is positioned. Irises 14 are made of a soft magnetic material such as soft iron and have a hole 16 therein. Magnet 10 is coaxially circumscribed by cladding magnet 24. Cladding magnet 24 has a longitudinally varying remanence from a low remanence at end 19 to a high remanence at end 21. A cylindrical axially magnetized bucking end magnet 38 is placed adjacent the iris 14 adjacent the high remanence end 20 of magnet 10. Bucking end magnet 38 is magnetized in a direction represented by arrows 12 thereon. Cylindrical bucking end magnet 38 has an axial hole therethrough. Ringed-shaped bucking end corner magnet 39 is positioned in the corner adjacent cladding magnet 24 and bucking end magnet 38. Corner magnet 39 is magnetized in a direction represented by the arrows thereon.

The operation of the device can best be understood with reference to FIG. 2. Magnets 10 and 24 create a magnetic field within bore 22. The magnetic field is substantially of equal strength in the lateral direction but increases in strength from the low remanence end 18 of magnet 10 to the high remanence end 20 of magnet 10. This increasing magnetic field is due to the increasing remanence of magnet 10 and is made more intense by cladding magnet 24. The outer exterior surface 28 of magnet 10 will increase in magnetic potential from end 18 to end 20, with reference to the magnetic potential at end 18. If the remanence of magnet 10 is constant the magnetic potential from end 18 to end 20 would increase linearly, but since the remanence of magnet 10 increases the magnetic potential will increase non-linearly. This aids in creating the increasing magnetic field strength within bore 22. Therefore, surface 28 increases non-linearly in magnetic potential from end 18 to end 20, with reference to the potential at end 18. Magnet 24 circumscribing magnet 10 has a non-linear varying remanence from a low remanence at end 19 to a high remanence at end 21. The varying remanence of magnet 24 is matched to the increasing magnetic potential along surface 28. Therefore, the magnetic potential difference between surface 28 and the outer exterior surface 26 on magnet 24 will match the increasing magnetic potential difference along surface 28 from end 18 to end 20, with reference to end 18. The radial magnetization of magnet 24 is directed radially inward so that it bucks or reduces the magnetic potential along surface 28. Because of the varying remanence of magnet 24 it can buck the increasing magnetic potential along surface 28 by increasing amounts while still maintaining a constant radial thickness. Therefore, the magnetic potential along the outer exterior surface 26 of magnet 24 will be a constant. This constant magnet potential along the surface 26 results in reduced magnetic flux leakage. Iris 14 adjacent end 20 will have a higher magnetic potential than surface 26. This magnetic potential difference will result in magnetic flux leakage. To avoid this, a bucking end magnet 38 is used to buck or off set-the magnetic potential of iris 14 so that the exterior surface of bucking end magnet 38 is equal to the magnetic potential along surface 26, thereby eliminating any magnetic potential difference and resulting flux leakage. To avoid magnetic flux leakage at the corner of bucking end magnet 38 and cladding magnet 24, ring-shaped bucking corner magnet 39 is used. Corner magnet 39 is magnetized in the direction indicated by the arrows thereon. Better magnetic flux shielding would be accomplished if corner magnet 39 has a magnetization that gradually varies from the direction of magnetization of cladding magnet 24 to the direction of magnetization of bucking end magnet 38.

In FIG. 3 a longitudinal cross section of another embodiment of the invention is shown. The embodiment of the invention shown in FIG. 3 makes possible additional savings of weight and material. Magnet 10 is coaxially circumscribed by a remanence varying cylindrical cladding magnet 29. Cladding magnet 29 is radially magnetized. Arrows 12 on cladding magnet 29 represent the direction of magnetization with the head of arrow 12 pointing in the direction of the north pole of magnet 29. Remanence varying cladding magnet 29 has an augmenting portion 32 extending from end 18 of magnet 10 to a circumferential portion 36 on magnet 10. The magnetic remanence of augmenting portion 32 is greatest adjacent end 18 of magnet 10 and decreases to a low magnetic remanence adjacent circumferential portion 36 on magnet 10. The direction of magnetization of augmenting portion 32 is radially outward as indicated by arrows 12. Remanence varying cladding magnet 29 has a bucking portion 25 extending from circumferential portion 36 on magnet 10 to end 20 on magnet 10. The remanence of bucking portion 25 increases from the section of cladding magnet 29 adjacent circumferential portion 36 on magnet 10 to the section of magnet 29 adjacent end 20 of magnet 10. The magnetic remanence of bucking portion 25 is low adjacent circumferential portion 36 and high adjacent end 20. Bucking portion 25 is magnetized in a direction radially inward as indicated by arrows 12. The magnetic potential along the outer exterior surface 28 of magnet 10 increases from end 18 to end 20 as described in FIG. 2. Augmenting portion 32 adds to or augments the increasing magnetic potential from end 18 of magnet 10 to circumferential portion 36. Augmenting portion 32 adjacent end 18 augments the magnetic potential on surface 28 of magnet 10 to a higher magnetic potential on surface 34 of augmenting portion 32 equal to the magnetic potential difference between end 18 and circumferential portion 36 of magnet 10. Augmenting portion 32, due to its varying remanence, decreases the magnitude of augmenting or adding of magnetic potential while progressing from end 18 to circumferential portion 36. Augmenting portion 32 decreases in the magnitude of magnetic potential it contributes to surface 28 so that surface 34 of augmenting portion 32 is a constant equal to the magnetic potential between end 18 and circumferential portion 36 of magnet 10. As the magnetic potential increases along surface 28 from the circumferential portion 36 to end 20 bucking portion 25 bucks or reduces the magnetic potential along surface 28 resulting in a lower magnetic potential surface along surface 27 on bucking portion 25. The varying remanence of bucking portion 25 results in an increase in magnetic potential difference between surfaces 27 and 28 while progressing from the section adjacent circumferential portion 36 and the section adjacent end 20. The increasing magnetic potential difference between surfaces 27 and 28 corresponds to the increasing magnetic potential between circumferential portion 36 and end portion 20 so that a constant magnetic potential exist along surface 27 of bucking portion 25 equal in magnitude to the magnetic potential difference between end 18 and circumferential portion 36 on magnet 10. This results in a constant magnetic potential, with reference to end 18 of magnet 10 along the surfaces 34 and 27. This constant magnetic potential along the surfaces 34 and 27 is equal to the magnetic potential between end 18 and circumferential portion 36. The lack of magnetic potential difference along surfaces 34 and 27 results in a substantial reduction of flux leakage therebetween. The use of a magnetic potential along surfaces 34 and 37 of a value found between end 18 and end 20 rather than the magnetic potential as found at end 18 results in substantial savings of size, weight, and cost. The magnetic potential of iris 14 adjacent end 20 is equal to the magnetic potential difference between end 18 and end 20 of magnet 10. To decrease the magnetic potential along the exterior surface, bucking end magnet 40 is used. Bucking end magnet 40 is placed adjacent iris 14 adjacent end 20 of magnet 10. Bucking end magnet 40 is axially magnetized as indicated by arrows 12 thereon. Bucking end magnet 40 reduces the magnetic potential along the outer exterior surface of iris 14 adjacent end 20 of magnet 10 to a value equal to that at circumferential portion 36 with reference to end 18. This will result in a constant magnetic potential difference between surfaces 34, 27, and the outer exterior surface of bucking end magnet 40. In the corner adjacent bucking portion 25 and bucking end magnet 40 is positioned ring-shaped bucking corner magnet 44. Bucking corner magnet 44 is magnetized in the direction indicated by the arrows thereon. Corner magnet 44 helps in eliminating magnetic flux leakage from the corner. Similarly, the magnetic potential of iris 14 adjacent end 18 of magnet 10 is at a magnetic potential of that at end 18. An augmenting end magnet 42 is positioned adjacent iris 14 adjacent end 18 of magnet 10 to increase or augment the magnetic potential of iris 14 adjacent end 18 so that the outer exterior surface of augmenting end magnet 42 is equal to that at circumferential portion 36 with reference to end 18. Therefore, the outer exterior surface of augmenting end magnet 42 is equal to that of surfaces 34, 27, and the outer exterior surface of bucking end magnet 40. In the corner adjacent augmenting portion 32 and augmenting end magnet 42 is positioned ring-shaped augmenting corner magnet 46. Augmenting corner magnet 46 is magnetized in the direction indicated by the arrows thereon. Corner magnet 46 helps in eliminating magnetic flux leakage from the corner. The outer exterior surface of the device being at a substantially equal magnetic potential with reference to end 18 results in a substantial reduction of magnetic flux leakage. This results in an intensified magnetic field within bore 22. End magnets 42 and 40 have apertures therein so that a beam of charged particles may enter.

The specific magnetic configuration just described results in a laterally uniform longitudinally increasing magnetic field within bore 22. When a stream of charged particles enters through hole 16 in iris 14 adjacent end 18 of magnet 10 it encounters the magnetic field within bore 22. When the charged particles motion deviates from the magnetic field direction a charged particle will be forced to travel down bore 22 toward end 20 in a spiral of diminishing diameter.

It should be understood that the embodiments depicted can be combined in different configurations, and that numerous modifications or alterations may be made therein without departing from the spirit end scope of the invention as set forth in the appended claims.

What is claimed is:

1. A magnetic circuit having low magnetic leakage comprising:

a constant radial thickness, remanence varying axially magnetized cylindrical magnet having an axial bore therethrough with a longitudinally linearly increasing magnetic field therein; and a constant radial thickness, remanence varying radially magnetized cladding magnet coaxially circumscribing said cylindrical magnet.

2. A magnetic circuit as in claim 1 wherein:

said cylindrical magnet has a low magnetic remanence at one end and a high magnetic remanence at the other end.

3. A magnetic circuit as in claim 1 wherein:

said cladding magnet has a low magnetic remanence at one end and a high magnetic remanence at the other end.

4. A magnetic circuit as in claim 3 wherein:

the low magnetic remanence at one end of said cylindrical magnet is adjacent the low magnetic remanence at one end of said cladding magnet.

5. A magnetic circuit as in claim 4 further comprising:

an iris of soft magnetic material placed adjacent each end of said cylindrical magnet.

6. A magnetic circuit as in claim 5 further comprising:

an axially magnetized bucking magnet adjacent said iris adjacent the high magnetic remanence at the end of said cylindrical magnet.

7. A magnetic circuit as in claim 6 further comprising:

a ring-shaped bucking corner magnet adjacent said axially magnetized bucking magnet and said cylindrical magnet.

8. A magnetic circuit having low magnetic leakage comprising:

a constant radial thickness remanence varying axially magnetized cylindrical magnet having an axial bore therethrough; and a constant radial thickness remanence varying radially magnetized cladding magnet coaxially circumscribing said cylindrical magnet including an augmenting portion of said cladding magnet magnetized in a direction augmenting the magnetic potential of the outer exterior surface of said cylindrical magnet to a magnetic potential equal to that on an outer circumferential portion between the ends of said cylindrical magnet from one end thereof to said circumferential portion thereof and a bucking portion of said cladding magnet magnetized in a direction bucking the magnetic potential of the outer exterior surface of said cylindrical magnet to a magnetic potential equal to that on said circumferential portion from said circumferential portion thereof to the other end thereof.

9. A magnetic circuit as in claim 8 wherein: said cylindrical magnet has a low magnetic remanence at one end, and a high magnetic remanence at the other end.

10. A magnet circuit as in claim 9 wherein: the low magnetic remanence at one end of said cylindrical magnet is adjacent said augmenting portion, and the high magnetic remanence at the other end of said cylindrical magnet is adjacent said bucking portion.

11. A magnetic circuit as in claim 10 further comprising: an iris of soft magnetic material placed adjacent each end of said cylindrical magnet.

12. A magnetic circuit as in claim 11 further comprising: an axially magnetized bucking magnet adjacent said iris adjacent the high magnetic remanence at the end of said cylindrical magnet; and an axially magnetized augmenting magnet adjacent said iris adjacent the low magnetic remanence at the other end of said cylindrical magnet.

13. A magnetic circuit as in claim 12 further comprising: a ring-shaped bucking corner magnet adjacent said axially magnetized bucking magnet and said cylindrical magnet; and a ring-shaped augmenting corner magnet adjacent said axially magnetized augmenting magnet and said cylindrical magnet.

14. A magnetic circuit as in claim 8 wherein:

said circumferential portion is the axial magnetic midpoint of said cylindrical magnet.

* * * * *